United States Patent [19]

Webster

[11] Patent Number: 4,826,571

[45] Date of Patent: May 2, 1989

[54] ROLLER-TYPE PRESSES INCLUDING METHODS ASSOCIATED THEREWITH

[76] Inventor: David R. Webster, 32 Forden Avenue, Westmount, Quebec, Canada, H3Y 2Y8

[21] Appl. No.: 1,862

[22] Filed: Jan. 9, 1987

Related U.S. Application Data

[63] Continuation of Ser. No. 637,276, Aug. 3, 1984, abandoned.

[51] Int. Cl.[4] ..... D21F 3/08

[52] U.S. Cl. ..... 162/205; 162/206; 162/358; 100/93 RP; 100/168; 100/176; 29/113.1; 29/116.1

[58] Field of Search ..... 162/205, 206, 358, 360.1, 162/352, 387, 361; 100/93 RP, 162 B, 168, 169, 170, 176, 155 R; 29/113 R, 113 D, 116 R, 116 AD, 129.5

[56] References Cited

U.S. PATENT DOCUMENTS

| | | | |
|---|---|---|---|
| 2,775,793 | 1/1957 | Cotchett | 29/116 R |
| 3,012,301 | 12/1961 | Rogers et al. | 29/116 R |
| 3,131,625 | 5/1964 | Küsters et al. | 100/170 |
| 3,140,512 | 7/1964 | Hausman | 100/170 |
| 3,157,935 | 11/1964 | Birch | 29/116 R |
| 3,230,604 | 1/1966 | Woxvold | 29/129.5 |
| 3,418,703 | 12/1968 | Thiry | 100/155 R |
| 3,528,883 | 9/1970 | Lundin | 162/360.1 |
| 3,535,760 | 10/1970 | James | 29/113 R |
| 3,657,782 | 4/1972 | Mott | 129/116 R X |
| 3,747,181 | 7/1973 | Nykopp et al. | 29/116 AD |
| 3,753,276 | 8/1973 | Reish | 29/129.5 |
| 3,896,719 | 7/1975 | Goodall et al. | 100/169 |
| 4,299,162 | 11/1981 | Hartman et al. | 100/162 B |
| 4,510,823 | 4/1985 | Leech | 100/172 X |

FOREIGN PATENT DOCUMENTS

| | | | |
|---|---|---|---|
| 6813802 | 4/1970 | Netherlands | 29/113 AD |
| 1112597 | 5/1968 | United Kingdom | 162/DIG. 7 |

*Primary Examiner*—Kenneth M. Schor
*Assistant Examiner*—Andrew J. Anderson
*Attorney, Agent, or Firm*—Samuel Meerkreebs

[57] ABSTRACT

In a press for papermaking comprising in combination, a pair of elongated rollers arranged one to another to provide an adjustable elongated nip therebetween, each of the rollers comprising a substantially rigid elongated shaft and a substantially rigid elongated sleeve overlying and rotatably supported upon the elongated shaft, the respective shafts extending outboard of the respective sleeve to provide two pairs of parallel spaced shaft outboard portions, the improvement comprising, in the case of each roller, providing a circumferentially extending running fit between the outer surface of the shaft and the inner surface of the sleeve defining an elongated annular chamber extending lengthwise of the sleeve. Other embodiments are disclosed which include the shaft being tubular and pressurized, lubricant in the annular chamber and a cable system for urging the rollers together. A splashguard is also provided for preventing water on the surface of the rollers from rewetting the paper.

25 Claims, 1 Drawing Sheet

ROLLER-TYPE PRESSES INCLUDING METHODS ASSOCIATED THEREWITH

CROSS REFERENCE TO RELATED APPLICATION

This application is a continuation application of U.S. application Ser. No. 637,276, filed Aug. 3, 1984 now abandoned.

BACKGROUND OF THE INVENTION 1. field of the Invention

The present invention relates to presses comprising a pair of rolls arranged one to another to provide an adjustable nip therebetween. Accordingly, the invention relates to roller-type presses. The present invention more particularly relates to improvements in invention more particularly relates to improvements in such presses and methods based on use of such presses.

The present invention also relates to paper-making, and more particularly to a hot press for squeezing moisture from a continuous ribbon or web, such as paper and carrying felt. The press may also be used, for example, as a smoothing press, sizing press, reverse press and breaker press.

2. Description of the Prior Art

Most rolls in papermachine presses are supported at both ends by journals, normally solid, that have a much smaller diameter than the roll diameter. Sometimes the relatively small diameter journals are hollow, to accommodate heating means such as steam, to provide hot pressing. Both solid and hollow journals rotate with the roll. Also, the roll body acts as a rotary beam, for nip pressure.

Other rolls in papermachine presses are supported at both ends, likewise by hollow journals that rotate with the roll, but of large enough bore to admit a suction box into the roll. Again, the roll body acts as a rotary beam, for nip pressure.

Another type of known press roll comprises an outer rolling shell, and a separate fixed beam inside, with roller or equivalent bearings between shell and beam at the roll ends. Straight seals extending the full beam length, and attached to opposite sides of the beam, all combine with end seals to divide an annular space between shell and beam into two fixed chambers of "C" cross-section. A controlled hydraulic pressure is applied in one of the "C" chambers to deflect shell from beam a controlled amount, thereby to offset deflection from nip loading. The construction is known as a "swimming roll".

A further type of known press roll comprises an outer rolling shell and an inner fixed beam somewhat like a "swimming roll", except that the space for hydraulic pressure is occupied instead by lubricated stationary pads, adjustable to deflect shell from beam a controlled amount and likewise to offset deflection from nip loading.

A further type of known press roll utilizes an inflatable interior for bulging a roll body, slightly to a barrel shape, thereby to offset deflection from nip loading.

SUMMARY OF THE INVENTION

It is a prime object of the present invention to provide a roller type press of much simpler construction to those of the prior art, in particular to provide ones having extremely high roll stiffness, accordingly affording high load capacity. It may be said the present invention departs from the known constructions and introduces a means of reducing roll deflection, for a given diameter and material of roll, by bringing a novel means for roll stiffness, thereby introducing a high load capacity. The present construction may have a conventional crown or camber, ground to suit a given loading.

It is thus an object of the present invention to overcome load limitations of the prior art presses. The present invention achieves this by providing a beam virtually the whole inside diameter of a rolling shell, for greatest possible beam depth in a given shell.

Beam bending strength for a given span between supports is known to increase rapidly with an increase of beam depth, while beam deflection decreases rapidly. The amount of beam-strength increase and beam-deflection decrease, is set forth in standard textbooks and hand-books.

Beam bending strength for a uniform cross-section is known to vary directly as the moment-of-inertia of that beam section and therefore directly as the fourth power of beam depth. Thus, a doubling, for example, of beam depth will increase beam strength $(2)^4$ or 16 times, and an increase, for example, to a mere 1.2 times beam depth will increase beam strength $(2)^4$ or 2 times. This latter increase in beam depth or diameter is about the amount available inside shells of known fixed beam rolls.

Beam deflection for a uiform cross-section and uniformly distributed load is known to vary inversely as the moment-of-inertia of that beam section and therefore inversely as the fourth power of beam depth. Thus, a doubling, for example, of beam depth will decrease beam deflection $(2)^4$ or 16 times, and an increase, for example, to a mere 1.2 times beam depth will decrease beam deflection $(1.2)^4$ or 2 times.

In other words, a mere 20% increase of beam depth will double bending strength and halve deflection. In contrast to known art, the present construction, in terms of preferred embodiment, has the round internal beam throughout its length of a diameter virtually as big as the rotary shell inside diameter, thereby achieving greatest possible strength and least possible sag for a given shell size.

It is a further object of the present invention to relieve roll ends of much stress, by avoiding a concentration of stress at the shell ends. The present invention achieves this by a construction which avoids the use of roller bearings at the shell ends. Stress in a conventional roll reverses at each half turn, sometimes leading to metal fatigue, and thereby roll failure.

Various of the aforementioned known types of variable crown rolls with a non-rotary inner beam require space for roller bearings, at the shell ends, and such bearings are a localized zone of stress concentration.

In contrast, the shell, according to the present invention, is designed to be a traveling medium in the nip, squeezed directly against the internal beam, and the shell is not relied upon to be its own beam. The beam, according to the present invention, does not rotate with the shell; thus it does not suffer from stress reversals that lead to metal fatigue and cracking. As a result, the shell, according to the present invention, can be relatively thin walled, surface finished, and patterned for drainage without the troublesome cracking. Although in the case of the preferred embodiments, the beam does not rotate, it is visualized other embodiments might comprise beam rotation, in order to satisfy certain conditions, and would still offer substantial improvement over the prior art press designs.

The prior art constructions conduct nip load longitudinally in a roll shell to zones of load concentration along the shell, and in contrast, the present construction conducts nip load radially into a beam directly, thereby achieving the object of relieving the shell of much stress. In a sense, the present beam is a single long pad for relieving a rotary shell of much beam stress.

It is a further object of the present invention to support a rotary shell wholly on a lubricant film instead of on a pressurized lubricant pool or lubricated pads. The prior art designs utilize a lubricant pool pressurized for load carrying. In contrast, constructions according to the present invention utilize the surface tension inherent in a lubricant for load carrying. In a sense, the construction, according to the invention, is the reverse of a plain bearing, in that this construction has a fixed shaft with rotary exterior, whereas a plain bearing has a fixed exterior with rotary shaft. In accordance with preferred embodiments of the present invention, lubricant is spread between rotary shell and fixed round beam, by conventional lubricant feed and grooves. The load-carrying capacity of lubricant films and power relating thereto are well known. This "tube-in-a-tube" construction with running fit between the tubes can consume more power than would a roller-bearing contact. However, the present invention turns that mechanical disadvantage into a heat advantage by a novel means discussed hereinafter.

It is a further object of the present invention to heat a press by frictional rubbing. This heat is made useful by at least four means. Firstly, the present invention avoids having a water shower as used to lubricate a rubbing interface between a conventional suction box and roll interior, and thereby avoids having a press coolant discharging frictional heat to sewer. Secondly, the present invention recycles frictional heat of rubbing, by means of conventional lubricant feed and grooves. Heat gained from friction thereby accumulates for a temperature rise in the press, for aiding drainage, instead of heat being dissipated at the press. Some heat gained is added to the drainage and some to the sheet. Thirdly, the present invention is directed toward diverting drainage, after a nip, away from the felt, thereby to reduce an undesirable rewetting and cooling of the felt. Fourthly, the present invention is directed toward utilizing the heat of mechanical compression in a nip, previously not used because of the above-mentioned cooling effect of water shower, lack of recycling lubricant and cooling effect of rewetting after the nip. The heat of mechanical compression is permitted to accumulate in the press for a temperature rise, an aid to drainage with lowering of surface tension. Both resilient covering on a roll and felt are compressible, and a nip force times a distance of compression represents work, realized as heat equivalent. Some known presses have grooved rolls and blind-drilled rolls, without any suction roll, thus without any of the above-mentioned water shower for lubrication. Such known rolls thereby avoid losing that portion of heat otherwise discarded with shower water. Such known rolls also gain some heat by mechanical compression in a nip, but they do not gain heat by frictional heat being recycled and by drainage being diverted away from a felt after the nip, for reducing a rewetting and cooling of the felt.

It is a further object of the present invention to add heat to the roll interior by conventional heating means such as oil, steam, flame, and electricity. Alternatively, heat may be extracted from the roll by conventional fluid circulating means, most commonly using water. Such cooling is directed toward preserving and prolonging a useful life of resilient roll coverings that have limits of operating temperature. Circulation of heat or cooled fluid is a means to even a temperature profile.

It is a further object of the present invention to heat a felt by a wrap on a press roll. As is well known, a ribbon has only a short time in a nip, commonly less than one one-hundredth of a second, a short time for heat transfer. As is also well known, the sudden impact of felt into a nip hammers moisture into a felt, and that moisture can rewet a sheet after a nip, unless drainage reversal is inhibited. In the construction according to the present invention, the drainage reversal and rewetting is inhibited, by heat lessening surface tension, thereby lessening adhesion of drainage to capillary surfaces in the felt. This felt wrap on a press roll provides a novel means of compensating for the short dwell time of ribbon in the heated nip.

It is a further object of the present invention to minimize friction between rotary tube and beam by heating the lubricant, a well-known way of lessening lubricant viscosity. Fluids differ greatly in mobility due to viscosity or internal friction. If not viscous enough, a lubricant will be squeezed out, while if too viscous, it will offer needless resistance to motion. The construction according to the present invention has such large diameter and length, compared to most plain journal bearings (to which this construction is similar), that end loss of load-carrying capacity is relatively small. End loss of lubricant, of course, requires to be stopped by end seals at the running fit of rotary tube and beam. The dependence of a coefficient of friction on lubricant viscosity, bearing clearance, rotational speed, and load pressure in a plain journal bearing is well documented. Heating a liquid makes it less viscous, while the opposite is true of gases, and some plain bearings for heavy loading are gas lubricated.

It is a further object of the present invention to inflate a roll with pressurized fluid such as hot oil or steam, by sealing the hollow beam ends except for heat-connection means. Fluid pressure on the sealed ends tends to tension the beam, and any beam has a face of longitudinal compression and an opposite face of longitudinal tension. The compression face has a tendency toward buckling that makes it a critical element for failure in beams, while the opposite face in tension can normally accommodate additional tension. Consequently, inflating the beam in this construction reduces the longitudinal compression and thereby increases beam strength while reducing deflection.

It is a further object of the present invention to provide a lighter weight press compared to those of the prior art and a less costly press. This is achieved by the present invention, firstly by improving beam efficiency through providing more beam depth compared to known fixed-beam rolls, and secondly, by eliminating much dead weight compared to known fixed-beam rolls. Thus, as a result of the present invention, eliminated are the weight of hydraulic pool, long seals, pads, and much weight of beam cross-section omitted when a deeper beam is used for comparable load capacity.

In one aspect of the present invention, there is provided in a press for papermaking comprising in combination a pair of elongated rollers arranged one to another to provide an adjustable elongated nip therebetween, each of the rollers comprising a substantially rigid elongated shaft-like portion and a substantially rigid elongated sleeve-like portion overlying and rotatably supported upon the elongated shaft-like portion, the respective shaft-like portions extending outboard of the respective sleeve-like portions to provide two pairs of parallel spaced outboard extending shaft-like portions, the improvement comprising, in the case of each roller, providing a circumferentially extending running fit between the outer surface of the shaft-like portion and the inner surface of the sleeve-like portion defining a running fit clearance therebetween.

In a further aspect of the present invention, there is provided in a press for papermaking comprising in combination a pair of elongated rollers arranged one to another to provide an adjustable elongated nip therebetween, the improvement comprising scraper blades disposed adjacent to and extending downstream of each of the rollers whereby to lie in spaced relation one to another on opposite sides of the feedpath passing through the nip and splashguard means extending downstream of each of the rollers whereby to lie on opposite sides of the feedpath passing through the nip and arranged to aid in preventing direct or indirect rewetting of the paper web passing through the nip. This could be moisture from the paper or showers entering pores on the wall or blind drilled holes or grooves.

In a further aspect of the present invention, there is provided in a press for papermaking comprising in combination a pair of elongated rollers arranged one to another to provide an adjustable elongated nip therebetween, the improvement comprising providing, in at least one of the rollers, a shaft support therefor comprising an elongated enclosed tube member adapted to be pressurized therewithin by a fluid, whereby to provide at least one inflated beamshaft support.

In a further aspect of the present invention, there is provided a method of obtaining relatively high nip pressure between the rolls of a roller press comprising the steps of: (a) rotatably supporting each roll on an elongated shaft support which extends in running fit contact with the inner bore surface or surfaces of the roll, whereby to provide a relatively narrow annular elongated chamber extending lengthwise of the respective rolls; (b) providing seal means adapted to seal the chamber; and (c) providing a lubricant in the sealed chamber whereby upon rotation of the roll relative to the shaft support, the roll is wholly supported upon a lubricant film.

In a further aspect of the present invention, there is provided a method of heating at least one of the rollers of a roller type press, comprising the steps of (a) providing the roller with a bore which extends substantially throughout the length thereof and adapted over said length to provide a running fit with a tubular shaft support passing through the bore, thus to provide a tube-in-a-tube construction with running fit therebetween; (b) providing lubricant intermediate the roller and shaft support; and (c) rotating the roller upon the tubular shaft support whereby to generate heating of the roller.

BRIEF DESCRIPTION OF THE DRAWINGS

The invention is illustrated by way of example in the accompanying drawings, wherein.

DESCRIPTION OF THE PREFERRED EMBODIMENTS

Figure 1:
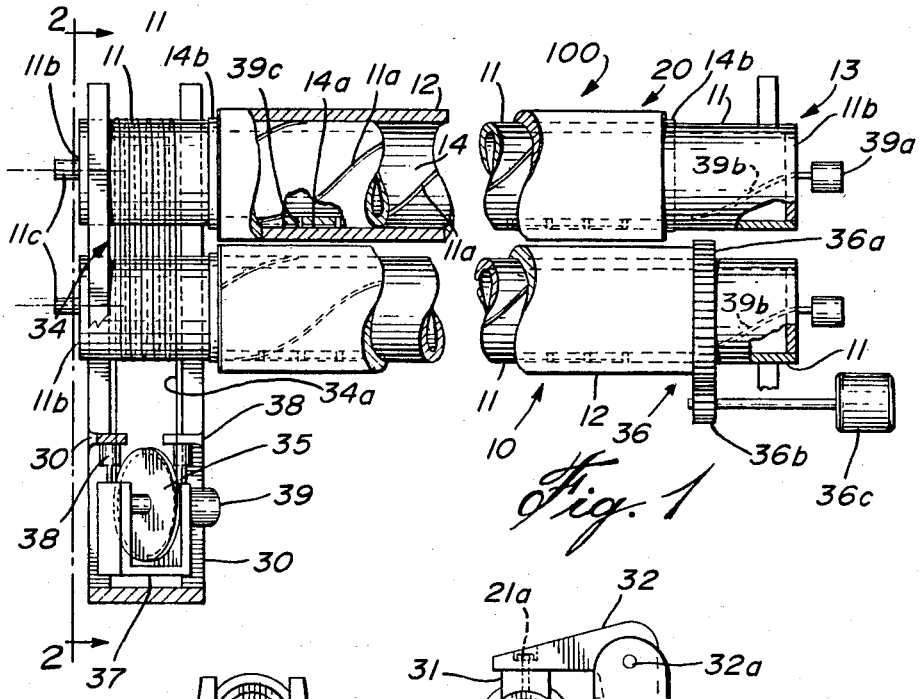
FIG. 1 is a diagrammatic side elevational view of a press in accordance with the present invention.

Referring to FIG. 1, there is seen a press 100 having a pair of elongated rollers 10 and 20, arranged one to another to provide an adjustable elongated nip therebetween. Each roller 10 and 20 comprises a substantially rigid elongated journal 11 and a substantially rigid elongated sleeve 12 overlying and rotatably supported upon shaft 11. As noted, shaft 11 extends outboard of sleeve 12 to provide two pairs 13 of parallel spaced outboard extending shafts. The bore 14, defined by sleeve 12, is sized to provide a running fit with shaft 11. By running fit is meant a running fit in the range found in, for example, —Mechanical Standard Tables—tolerances and allowances for running fits. The space comprising such running fits defines running fit clearance **14*a*. Clearance 14*a* is sealed at its ends by lubricating sealing means 14*b*, being of commercially available type and suitable for sealing the lubricant medium used within clearance 14*a***, which may comprise a gas, oil or water, etc. basis.

Shaft 11 and sleeve 12 may comprise any suitable material, including high strength steels and preferably include, on their working surfaces, grooves or the like **11*a*, for conveying and distributing the lubrication medium fed thereto. In the case of the one preferred embodiment disclosed, the lubricant is fed via rotary joint 39*a* mounted in shaft end wall 11*b* and thence through a supply pipe 39*b*operatively connected to feed holes 39*c* in shaft 11**.

Figure 3:
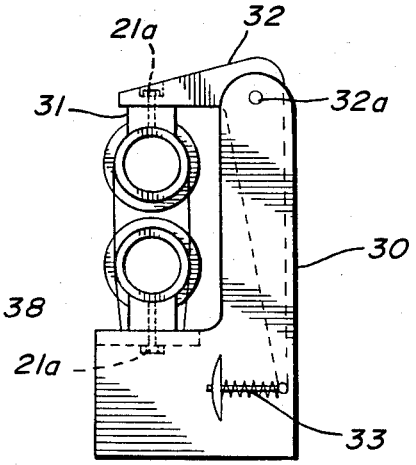
FIG. 3 is a diagrammatic end elevational view of a press in accordance with the present invention but showing an alternative known method of mounting the rolls in accordance with the present invention.

In the preferred embodiments disclosed, rolls 10 and 20 are mounted in conventional known manner, as seen in FIG. 3. In such case, shaft 11 of roller 10 is fixedly secured to frame 30 via abutment 31 and roller 20 is swingably mounted to frame 30 via lever arm 32, pivotally mounted via a pin **32*a*, and also having an abutment 31 thereon. As seen, movement of roll 20 toward roll 10 and also nip pressure therebetween, is controlled by a well-known control device 33**, namely, a well-known pressure applicator.

Although a swingable mounting has been mentioned, other suitable adjustable mounting of the rollers may be used, including providing a slidable mounting actuated by a piston-cylinder device. In such instance, at least one of the rollers may be slid toward the other to form the nip, using a piston-cylinder device on each end of the shafts 11.

A pair of locking bolts **21*a* are provided to release shafts 11 when they need to be rotated by creep motor 39**, for compensating for wear taking place thereon, discussed hereinafter.

Alternatively, movement of rolls 10 and 20 toward one another and the nip therebetween, may be controlled by a device in accordance with the present invention comprising cable means, illustrated in FIGS. 1 and 2. In such instance, roll 20 may be pivotally mounted in a similar manner to that shown in FIG. 3, including utilizing control device 33 or an equivalent to keep rolls 10 and 20 under pressure at the nip.

Figure 2:
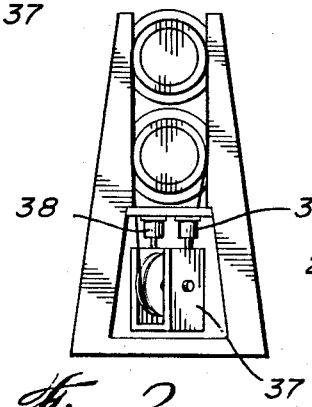
FIG. 2 is a diagrammatic sectional end elevational view of the press shown in FIG. 1, taken along line 2—2.

As seen in FIGS. 1 and 2, cable means 34 comprises a closed loop cable 34*a* which is entrained around the shafts 11 extending outboard of sleeve 12 and extends around pulley wheel 35. A pulley ratio effect in tensioning is provided by cable means 34 and relatively very high nip pressure may be achieved. Pulley wheel 35, as seen in FIG. 1, is movably mounted relative rolls 10 and 20 by a cradle frame 37, controlled movement thereof being effected by a pair of hydraulic cylinder jacks 38 acting against frame 30. As will be realized, although not shown in the drawings, a cable means 34 and pulley wheel 35 are also disposed at the opposite end of rolls 10 and 20 adjacent ring gear drive 36 for providing controlled nip across the width of rolls 10 and 20.

As a further refinement, pulley wheel 35 may be drivingly connected to motor means, namely, a creep motor 39, which is selectively operated to periodically rotate shafts 11 of rolls 10 and 20 relative to each other to thus compensate for flatting wear occurring on shafts 11. Bolts 21*a* are provided for respectively locking and releasing shafts 11 respective abutments 31, thus to facilitate the limited relative rotation of the parts when carrying out the wear adjusting procedure.

As an alternative, shafts 11 may be of non-tubular construction, although being tubular, apart from affording weight saving, simplifies the design in terms of accommodating the lubrication conveying system. It also allows for fluid pressurization, resulting in a stiffened shaft. Pressurization of shaft 11 is accomplished using conventional means, including a rotary joint 11*c* mounted in end walls 11*b*.

Ring gear drive 36 includes ring gear 36*a* secured to sleeve 12 and pinion 36*b* driven by motor 36*c*. Rotor 20 may also include a ring gear 36*d* (not shown) meshed for drive with ring gear 36*a* whereby rolls 10 and 20 are both driven by pinion 36*b*. Alternatively, press 100 may comprise rolls 10 and 20 as idler rolls, i.e., without drive means.

As an alternative to using an applied lubricant, i.e., petroleum products, foam-type products, water, air, etc., for providing a lubricant film, self-lubricating materials may be used for at least the working surface of the shaft 11 or sleeve 12 in the clearance 14*a*. Such may include commercially available products including graphite impregnated materials, oilite, etc.

The operation of press 100 will now be described. When roll 10 and possibly roll 20 are driven by motor 36*c*, or in any event, when rolls 10 and 20 have been rotating at speed for a given time, sleeves 12 will be fluidly supported on the lubricant in clearances 14*a*. Furthermore, heat will be generated from the rubbing action occurring between shaft 11 and sleeve 12. This heat can aid the drying of the web of paper or other material passing through the roll nip. The choice of lubricant and rotational speed of the rolls may be utilized to control the degree of heat generated. If additional heat is required, such may be obtained with steam or other medium as aforediscussed, introducing such into the hollow area of shaft 11.

Figure 4:
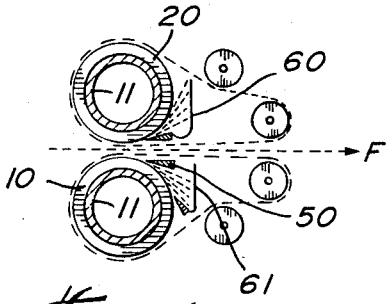
FIG. 4 is a part sectional elevational view of a pair of press rollers in accordance with the present invention showing double felt, scraper and splash shielding, in accordance with the present invention.
Figure 5:
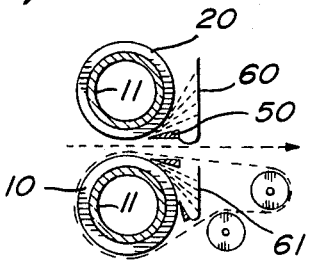
FIG. 5 is a view similar to that seen in FIG. 4 but showing single felting.

FIGS. 4 and 5 disclose additional refinements. In FIG. 4, a scraper blade 50 for use in scraping liquid from rolls 10 and 20 is disposed adjacent to and extends downstream of each of rolls 10 and 20 to lie in spaced relation one to another on opposite sides of feedpath F passing through the roll nip. Scraper 50 resembles a backwards mounted doctor blade. Mounted in conjunction with scraper 50 are splashguards 60 and 61, accordingly located on opposite sides of the feedpath F and extending downstream of each of scraper 50 and arranged to aid in preventing direct moisture from paper or indirect moisture from conventional felt showers and roll surface patterns from rewetting of the web passing through the rollers' nip. In the case of FIG. 4, a paper web is shown supported on respective sides thereof by felting. In the case of FIG. 5, a single felting is shown.

As will be evident to those skilled in the art to which the invention is directed, scrapers 50 and splashguards 60 and 61 may be secured in position by any suitable means including the option of securing the same to the structure used to support and mount rolls 10 and 20. Alternately, scrapers 50 and splashguards 60 and 61 may be secured in position by structure not part of the structure comprising the roller press.

The scrapers 50 are arranged as close as possible to the nip, as shown in FIGS. 4 and 5, with the splashguards arranged, as shown in these drawings, such that they collect any water being sprayed off the roller downstream of the blades 50. The water is present in grooves or pores of the roller surface or even in drilled blind holes, and thus passes the scraper blade 50 but is sprayed off the roller by centrifugal force. The splashguards contain the water being splashed off by centrifugal force from the roller past the blades 50. It is interesting to note that very little surface water remains on the roller past the nip as the felts are re-expanding to their normal condition, and any water would be absorbed by the felts. Most of the water which is being protected against is the water which would be present in the grooves or drill holes or even in the pores of the surface of the roller, and thus the splashguards 60 and 61 as well as the blades 50 will prevent this water from rewetting the felts or the paper any further.

I claim:

1. A press for papermaking comprising in combination: a pair of straight rigid elongated press rollers arranged one to another to provide an adjustable elongated nip therebetween, each of said rollers comprising a straight substantially rigid elongated shaft and a substantially straight rigid elongated sleeve enveloping and rotatably supported upon said shaft, the outside diameter of said shaft and the bore of said sleeve being of substantially constant dimension throughout their lengths, means for rotating at least one of said sleeves, the shafts extending outboard of the respective sleeves to provide opposite pairs of parallel spaced shaft outboard portions, means operably arranged adjacent said pairs of shaft outboard portions for moving said rollers towards one another and increasing pressure at said nip for dewatering of a web of pulp material, each roller comprising a circumferentially extending running fit between the outer surface of the shaft and the inner surface of the sleeve defining an elongated annular running fit clearance extending lengthwise of said sleeve, and a liquid lubricant film provided within said running fit clearance for supporting load throughout the length of said sleeve at said nip such that the shaft has a maximum constant diameter within the sleeve to provide the maximum beam depth to the roller.

2. The press as defined in claim 1, wherein said means for rotating at least one of said sleeves comprises a pinion driven ring gear, secured to said sleeve.

3. The press as defined in claim 1, wherein said means operably arranged adjacent said respective pairs of shaft outboard portions comprises a cable entrained around said shaft outboard portions.

4. The press as defined in claim 3, wherein said cable includes a portion thereof, engaging a stretcher means.

5. The press as defined in claim 4, wherein said stretcher means comprises a pivotally mounted pulley wheel.

6. The press as defined in claim 5, wherein said pivotally mounted pulley wheel is mounted on means for movement toward and away from said rollers.

7. The press as defined in claim 5, further comprising means for driving said pulley.

8. The press as defined in claim 1, wherein at least one of said shafts comprises an elongated, rigid, straight tube member.

9. The press as defined in claim 8, wherein said tube member includes means enclosing the same.

10. The press as defined in claim 9, wherein said means enclosing the tube member comprises a pair of end wall members respectively sealing the ends of the tube member, and fluid inlet means is located in at least one of said end walls permitting fluid to enter therewithin for fluid pressurizing said tube member.

11. The press as defined in claim 1, wherein the shaft of one of said rolls is fixedly mounted on a frame means and the shaft of said other roller is swingably mounted on said frame means.

12. The press as defined in claim 11, wherein said swingable mounting of said shaft comprises a lever arm.

13. The press as defined in claim 1, wherein at least one of said shafts is rotatably mounted.

14. The press as defined in claim 13, wherein both shafts are rotatably mounted and are rotated by a creep drive.

15. The press as defined in claim 1, including splashguard means disposed downstream of said nip on either side of a path extending from said nip and arranged to aid in preventing rewetting of a web passing along said path from liquid existing in pores, grooves or drill holes on the outer surface of said sleeve.

16. The press as defined in claim 15, wherein the splashguard means are provided with scrapers being disposed adjacent to each of the outer surfaces of said sleeves downstream of the nip and on either side of the path.

17. The press as defined in claim 1, wherein at least one of said shafts is rigidly secured to prevent rotation of the same relative to its mounting.

18. The press as defined in claim 1, including lubricant carrying means on said outer surface of said shaft and lubricant feed channeling connected thereto.

19. The press as defined in claim 1, including lubricant carrying means on said inner surface of said sleeve.

20. The press as defined in claim 1, wherein said outer surface of said shaft comprises self-lubricating material.

21. The press as defined in claim 1, wherein said inner surface of said sleeve comprises self-lubricating material.

22. A method of obtaining relatively high nip pressure between the rolls of a roller press in order to dewater a web of pulp material comprising the steps of:

(a) providing a pair of straight rigid elongated press rollers and arranging them one to another to provide a nip therebetween, (b) adjustably moving the rollers towards one another and increasing pressure at the nip, whereby each roller is comprised with a straight substantially rigid elongated shaft and a substantially straight rigid elongated sleeve enveloping and rotatably supported on the shaft, and the outside diameter of the shaft and the bore of the sleeve are of substantially constant dimension throughout their length, to provide an annular elongated running fit clearance extending lengthwise of the sleeve and the respective shaft, (c) providing a liquid lubricant in the running fit clearance continuously along the length of the shaft and sleeve, (d) rotating the sleeve relative to the shafts so that the lubricant extends throughout the running fit clearance and such that the sleeves are wholly supported upon a lubricant film, and (e) applying a force to bias the rolls together and provide said relatively high nip pressure.

23. A method as defined in claim 22, wherein the ends of the shafts extend outboard of the ends of the sleeves, and whereby step (e) comprises:

looping a cable around the ends of said shafts extending outboard of the ends of said sleeves and engaging the cable to respective cable tensioning devices operably positioned relative said rolls; and operating said tensioning devices to tension said respective cable, to provide relatively high nip pressure between said rolls.

24. A method as defined in claim 23, including the step of providing hydraulic jack means to move said stretching devices relative to said rolls to tension said respective cable means.

25. A method as defined in claim 22 wherein the liquid lubricant provided in the running fit clearance is of the type such that, upon rotation of the sleeve on the shaft, heat will be generated to heat the rollers, and including controlling the degree of heat of said rollers.

* * * * *